US007780586B2

(12) United States Patent
Gates

(10) Patent No.: US 7,780,586 B2
(45) **Date of Patent: *Aug. 24, 2010**

(54) TRAINING BENCH

(76) Inventor: Todd Gates, 188-30 87th Dr. Apt. #4S, Hollis, NY (US) 11423

( * ) Notice: Subject to any disclaimer, the term of this patent is extended or adjusted under 35 U.S.C. 154(b) by 0 days.

This patent is subject to a terminal disclaimer.

(21) Appl. No.: 12/324,118

(22) Filed: Nov. 26, 2008

(65) Prior Publication Data

US 2009/0137372 A1 May 28, 2009

Related U.S. Application Data

(63) Continuation of application No. PCT/US2007/012907, filed on May 31, 2007.

(51) Int. Cl.
*A63B 26/00* (2006.01)

(52) U.S. Cl. ..... 482/142

(58) Field of Classification Search ..... 482/142; 108/1–10, 136, 50.02, 115–116, 147.19, 108/147.2, 147.22, 150; 248/292.13, 150, 248/291.1, 291.12, 291.13, 166, 439; 297/461, 297/451.5

See application file for complete search history.

(56) References Cited

U.S. PATENT DOCUMENTS 1,019,861 A * 3/1912 Titus ..... 482/123
2,326,015 A * 8/1943 Davis ..... 38/40
2,343,289 A * 3/1944 Forse ..... 223/57
2,781,608 A * 2/1957 Cutrow ..... 108/9
3,112,928 A * 12/1963 Oswald ..... 482/55
3,114,545 A * 12/1963 Horn ..... 482/142
3,199,825 A * 8/1965 Bellows ..... 248/397
3,641,946 A * 2/1972 Charnay ..... 108/6
4,108,083 A * 8/1978 Espinosa ..... 108/6
4,154,173 A * 5/1979 Chesnut ..... 108/6
4,620,701 A * 11/1986 Mojden ..... 482/41
D288,459 S * 2/1987 Lee ..... D21/690
4,728,065 A * 3/1988 Coote ..... 248/129
4,943,040 A * 7/1990 Finstad et al. ..... 269/69
5,027,989 A * 7/1991 Nevius ..... 223/120
5,163,890 A * 11/1992 Perry, Jr. ..... 482/142
5,217,487 A * 6/1993 Engel et al. ..... 606/240
5,234,391 A * 8/1993 Shasek et al. ..... 482/111
5,295,936 A * 3/1994 Perry, Jr. ..... 482/144
5,393,280 A * 2/1995 Haviv ..... 482/56
5,611,762 A * 3/1997 Kaye ..... 482/104
D401,985 S * 12/1998 Wheeler ..... D21/686
5,860,899 A * 1/1999 Rassman ..... 482/142
5,884,935 A * 3/1999 Tholkes ..... 280/657
6,220,620 B1 * 4/2001 Harroun ..... 280/650
6,435,611 B1 * 8/2002 Walter ..... 297/316
6,694,891 B1 * 2/2004 Lai ..... 108/6

(Continued)

*Primary Examiner*—Lori Baker
(74) *Attorney, Agent, or Firm*—Millen, White, Zelano & Branigan, P.C.

(57) ABSTRACT

A training bench supports a user performing upper and lower body exercises and is comprised of a base, a seat, a main and adjustable support column, a pivoting support plate with angular adjustments, locking pins and rubber feet. The training bench has multiple vertical height adjustments independent of the seats' incline adjustments. All seat angles support a user's upper torso, lower torso or entire body. Ergonomics is a basis for the training bench structure. Many types of people are able to use the compact functional training bench regardless of their, height, size or exercise level.

19 Claims, 14 Drawing Sheets

U.S. PATENT DOCUMENTS 6,726,607 B1 * 4/2004 Ihli ..... 482/127
D491,618 S * 6/2004 Kuo et al. ..... D21/676
6,746,384 B2 * 6/2004 Cole et al. ..... 482/130
6,764,431 B2 * 7/2004 Yoss ..... 482/56
6,821,231 B1 * 11/2004 Hall ..... 482/51
D504,164 S * 4/2005 Ceppo ..... D21/686
6,988,979 B1 * 1/2006 Trainor ..... 482/142
D544,050 S * 6/2007 Webber ..... D21/686
7,278,959 B2 * 10/2007 Brown, III ..... 482/104
7,322,911 B2 * 1/2008 Webber ..... 482/142
7,322,913 B2 * 1/2008 Gates ..... 482/142
2003/0130100 A1 * 7/2003 Perez ..... 482/140
2003/0158018 A1 * 8/2003 Giannelli et al. ..... 482/95
2004/0018923 A1 * 1/2004 Schiff ..... 482/142
2005/0170939 A1 * 8/2005 Lin ..... 482/148
2006/0100070 A1 * 5/2006 Abdo ..... 482/121
2006/0148625 A1 * 7/2006 Garner ..... 482/123
2006/0217240 A1 * 9/2006 White et al. ..... 482/72
2007/0012827 A1 * 1/2007 Fu et al. ..... 248/163.1
2008/0276372 A1 * 11/2008 Lambarth ..... 5/611
2009/0017990 A1 * 1/2009 Ochi et al. ..... 482/6

* cited by examiner

TRAINING BENCH

The application is a continuation of International Application PCT/US2007/012907 filed May 31, 2007, which claims benefit priority from U.S. application Ser. No. 11/421,096 filed May 31, 2006, now U.S. Pat. No. 7,322,913, issued Jan. 29, 2008.

FIELD OF THE INVENTION

This invention relates to strength and conditioning equipment for home fitness portable fitness, or gym fitness.

BACKGROUND OF THE INVENTION

Traditional exercise benches are large and cumbersome. They are limited in function and are not feasible for home use unless a person has sufficient space. These benches also have limited capability for strength and conditioning by coaches of athletes because the benches are not versatile. This is because these benches are designed to function as an upper body exercise devices. These benches do not adjust vertically and are not capable of performing a multiple of lower body exercises correctly. Moreover, the prior art exercises benches are not configured to fully meet the needs of athletes (professional and amateur), fitness devotees, professional trainers, or anyone truly interested in optimum true-form exercise performance. They are made for an average sized person and do not take into consideration the many different sizes and performance requirements of people utilizing them. Exercise benches are widely used in home gyms, health clubs, training centers, and university weight rooms. Often there is a very long wait to use a bench because of the time it takes for users to adjust the benches to accommodate their body size and type of exercise they desire to perform.

Athletes and fitness devotees train differently than average people. These advanced users depend upon perfected form, proper sizing (height ratio to body size, strength, and a range of motion), isolated muscle movement, safe equipment, and immediate flexibility. This means they need unique and different training resources than currently available. The health and fitness industry does not always address these consumer's needs or think in the same way, strength and conditioning coach thinks. Strength coaches create programs with existing limited-function equipment provided them and make adjustments to this equipment according to their less than optimum resources. More thoughtful exercise equipment for athletes and fitness devotees would provide a much-needed resource for optimum exercise and training.

There are currently no compact functional exercise benches evident on the market that can be utilized for use by strength and conditioning coaches, gym training, and home fitness. Furthermore, current exercise benches are relatively heavy and do not adjust vertically in height and length.

Since the typical exercise bench has no height adjustments, exercise variations are limited. A tall person's relationship to an exercise bench is different from a shorter person's relation. Therefore, many exercises are not optimal for either person. In order to alleviate this problem, a person must either choose a different apparatus, abandon the particular exercise altogether, or perform it incorrectly (which can have many negative effects). For example the proper form when performing a "box-squat to parallel" on an exercise bench is determined by the height of an individual. "Parallel location" for a person who is 6' feet tall is different than for a person who is 5'6" tall. The exercise cannot be performed correctly if the height of the bench is not proper.

Typical exercise benches are limited to mostly upper body exercises because these benches have a standard height with no vertical adjustments. There are many types of exercises such as, squats, step-ups and explosive lower body movements that cannot be performed on a typical exercise bench effectively because it lacks vertical adjustment. As mentioned above, such exercises are limited in effectiveness and functionality due to the various heights of people performing them.

Many people would like to work out in the comfort of their home but do not have the space for an exercise bench. Also, people who are just starting a workout program might be intimidated by going to a gym and would rather start at home to build their self-confidence. A problem with purchasing a conventional exercise bench for home use is storage. Exercise benches are not made for apartments or small homes and are purchased for home use by people who have garages, basements or workout rooms with plenty for space for both use and/or storage. Those who live in apartments and small homes are ignored.

SUMMARY OF THE INVENTION

A training bench used for physical exercise comprises a base for supporting the training bench on a horizontal surface, the base having a selected lateral extent and a vertical support having a bottom portion attached to the base and upper portion extendible to selected fixed heights above the base by adjusting the vertical support. A platform is provided having a surface for supporting a portion of a person's body on the training bench and is connected to an angular coupling coupled to the upper portion of the vertical support. The angular coupling provides for angular adjustment of the platform in selected, fixed, angular positions with the respect to the vertical support to provide support for the back or front of the person's torso while the person's feet are on the horizontal surface, or for supporting the person's feet while the person sits on the horizontal surface.

In a further aspect of the training bench, the base has a lateral extent greater than the platform to provide stability to the platform.

In a further aspect of the training bench, the vertical support is a telescoping tube coextensive with a vertical axis, the telescoping tube having a plurality of stops for fixing the height thereof, and therefore the height of the platform attached to the top portion of the vertical support.

In a further aspect of the training bench, the stops are spaced fixed positions defined by holes in the telescoping tube, which receive a pin to lock the tube at a selected height.

In a further aspect of the training bench, the angular coupling is mounted on the telescoping tube by a pivot pin and the angular coupling has a plurality of angularly spaced holes therein which are spaced from the pivot pin, wherein the holes align with at least one hole in the top portion of the telescoping tube and receive a locking pin to fix the angular orientation of the platform with respect to the telescoping tube.

In a further aspect of the training bench, the base is comprised of a plurality of legs extending laterally of a vertical axis with respect to which the platform pivots.

In a further aspect of the training bench, the legs fold or telescope to reduce the extent thereof for storage.

In a further aspect of the training bench, the vertical support is a telescoping tube which is hinged with respect to the base so as to fold with respect to the base for storage.

In a further aspect of the training bench, the platform is alternately configured as a seat for supporting a person's body or a foot rest for supporting a person's feet, wherein each platform includes an annular coupling and a top tubular member so that the seat or foot rest are alternately mountable.

In a further attachment of the training bench, the legs include attachments for securing loops to the legs.

In a further aspect of the training bench, the platform is a seat and the platform includes laterally projecting handles for gripping by the person using the training bench.

In still a further aspect of the training bench, the training bench comprises a seat pad for supporting a user in a sitting, prone or supine position thereupon when exercising and an adjustable mounting plate for said the seat pad, which is secured to a pivot assembly system. A pivoting structural joint with multiple angularly positioned adjustment holes is locked in selected positions by a removable locking arrangement, which is connected to said pivoting structural joint to provide angular adjustment for the seat pad. The pivotal structural joint is supported on an inner support column for multiple angular adjustments with respect thereto. An outer support column is secured to a base axis and an inner support column with vertical pin adjustment holes being in the outer support column. A pin is connected horizontally to a side of the main support column to secure vertical seat height adjustments on said inner support column. A base support having two legs extending forward from said base axis and two legs extending toward said rear of said base axis provides stability for the training bench.

In a further aspect of the training bench, the pivoting structural joint deploys vertically and horizontally into a neutral and multiple angular positions and the inner support column deploys vertically with pivoting structural joint and inner support column deploying independently of one another.

In a further aspect of the training bench, wherein the removable inner support column is supported by the main support column, the main support column being configured to hold the inner support column as the inner support column deploys vertically in a frontal plane.

In a further aspect of the training bench, the main support column secures the removable inner support column in a selected vertical height position with a pin attached horizontally to the main support column and extending horizontally through vertical pin holes located on the inner support column.

In a further aspect of the training bench, the four legs of the base structure extend horizontally in the sagittal plane away from the base axis.

In still a further aspect of the training bench, the structural base frame has rubber feet attached to said bottom of said base legs for lateral stability and inertia.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF PREFERRED EMBODIMENT

It should be uniformly understood that the following detailed descriptions of the present invention's components, below illustrated in the figures as generally described below, does not limit the current design. The current representation is one of several ways the present invention could be configured. Therefore, the preferred embodiments are intended to only illustrate the present invention and not limit the scope of Applicants invention.

Figure 1A:
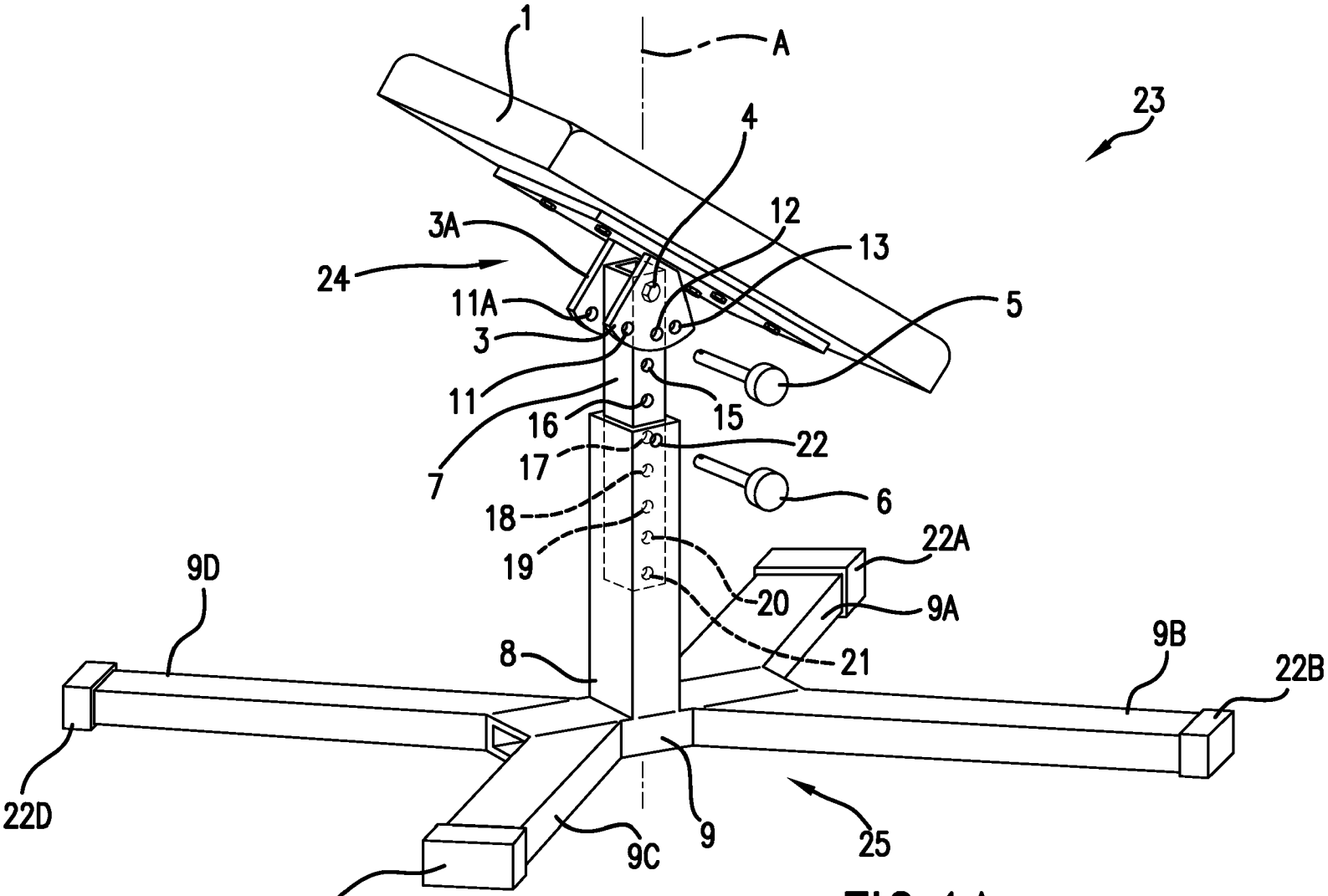
FIG. 1A is a perspective view with a portion in phantom showing one embodiment training bench configured in accordance with the present invention.
Figure 2:
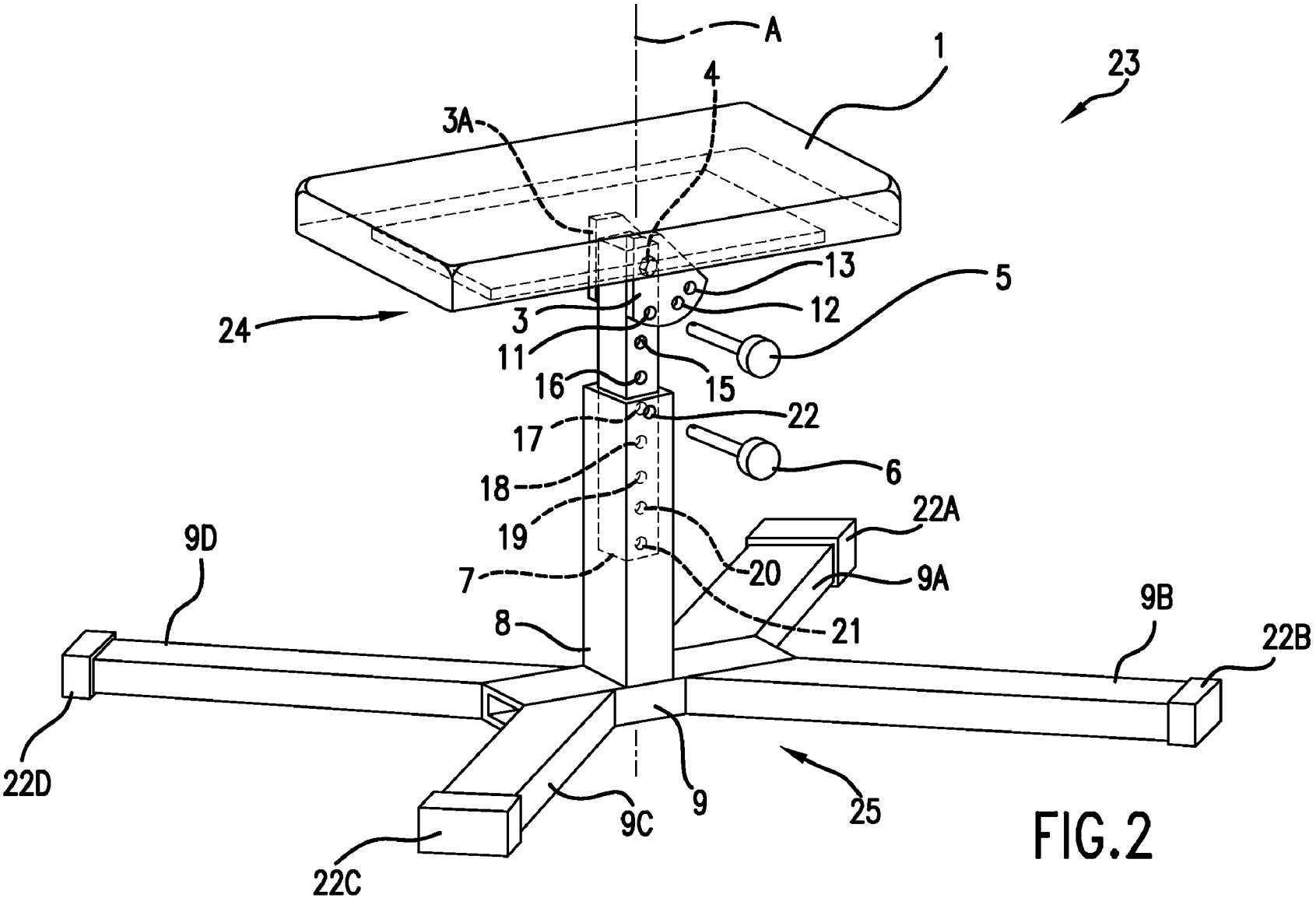
FIG. 2 is a perspective view, with portions in phantom of an assembly of the training bench.
Figure 3:
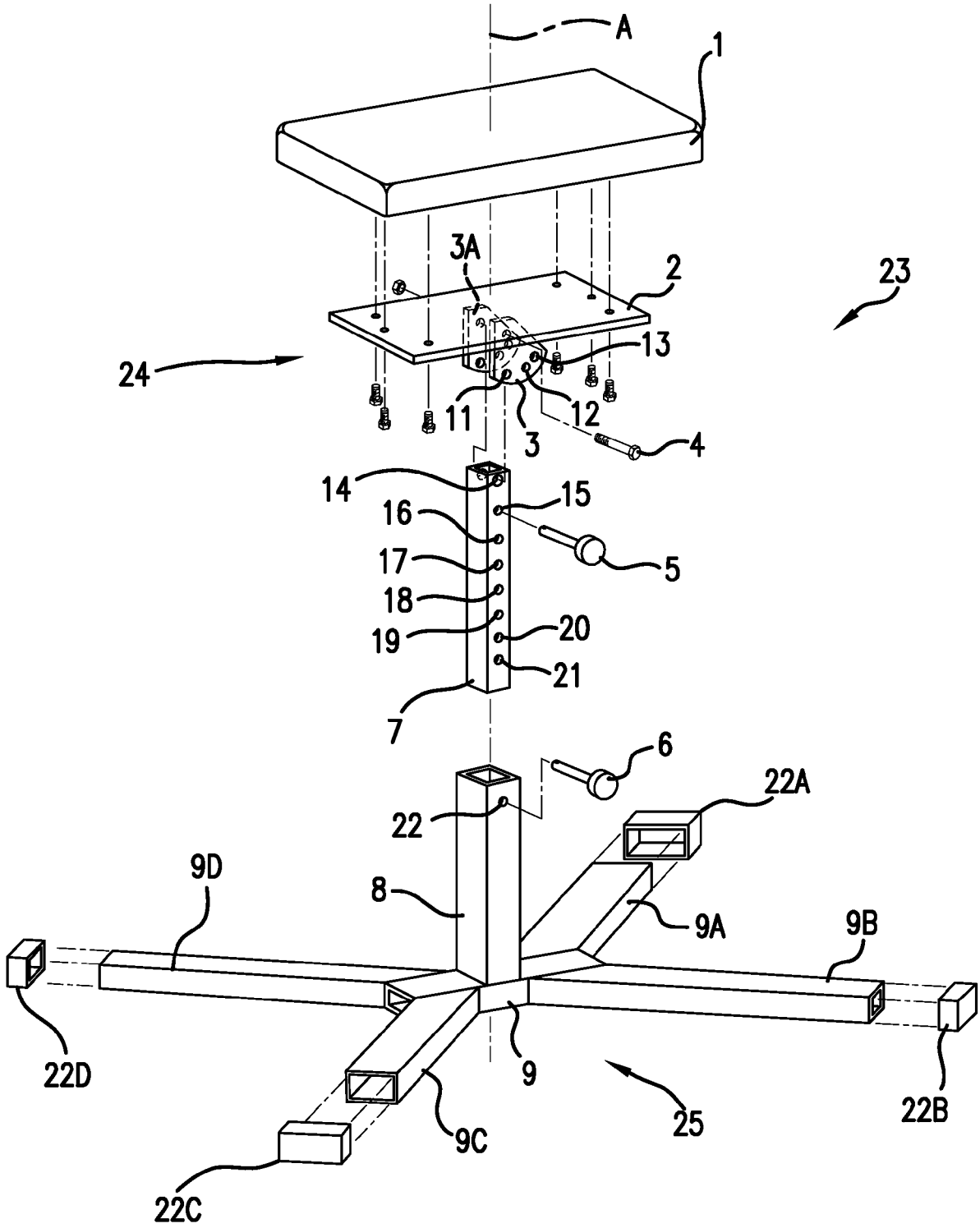
FIG. 3 is an exploded perspective view of the training bench.
Figure 4:
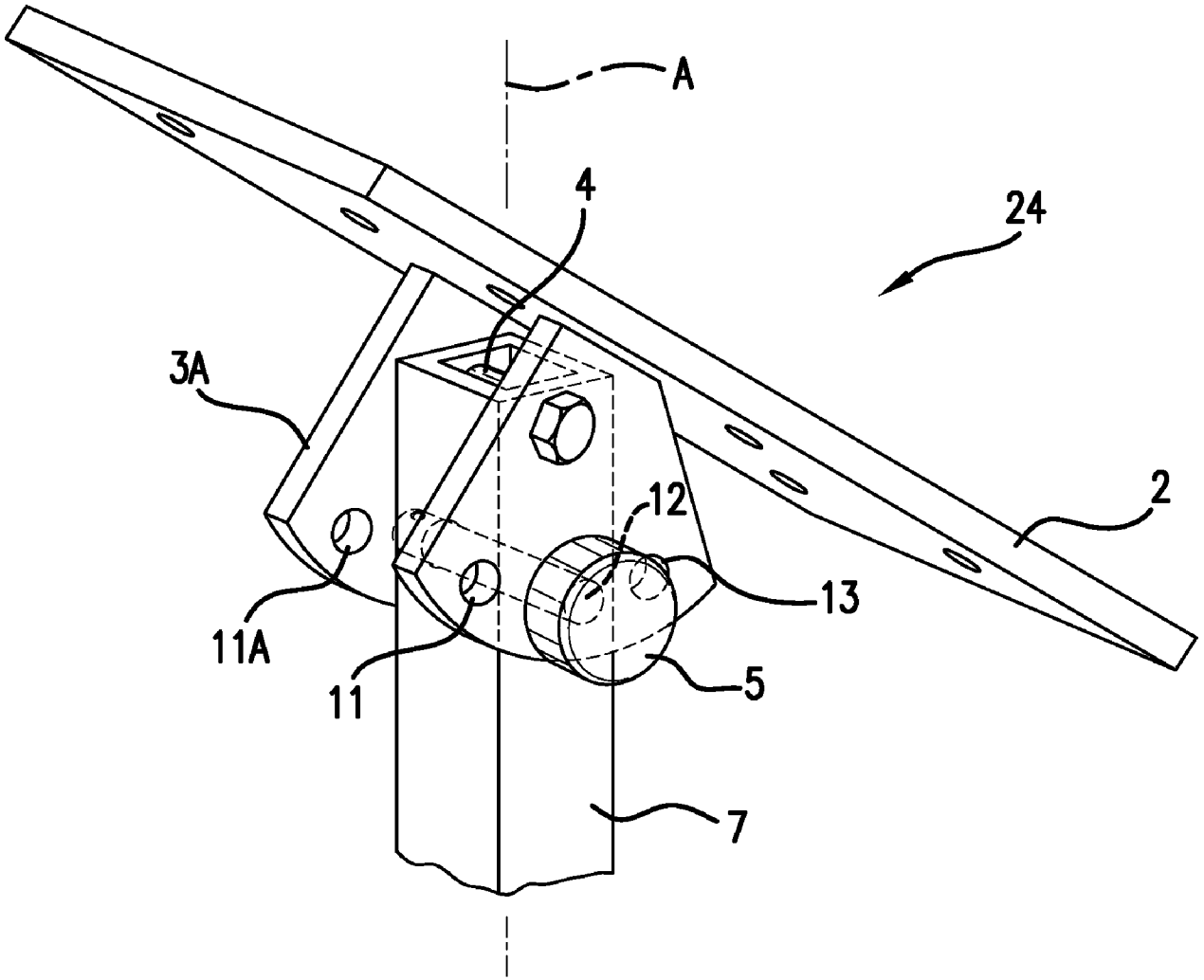
FIG. 4 is a perspective side view of the pivot plate assembly system with a locking pin engaging through an outer support column.
Figure 5:
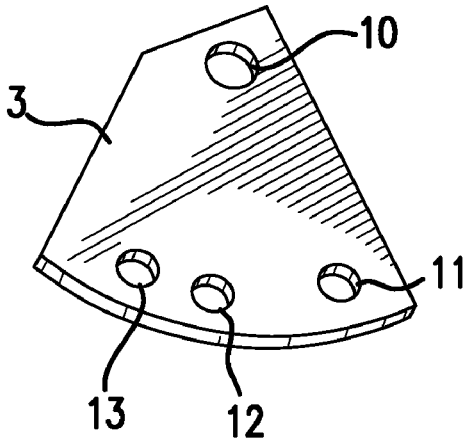
FIG. 5 is an enlarged side view of the pivot plate with quick release pinholes.

Referring to the drawings in more detail in FIGS. 1A, 3 and 4, the training bench 23 is compact, functional and is comprised of a sturdy base axis portion 9, which provides a base for supporting the training bench, the base having base legs 9A-9D extending in a perpendicular direction from a vertical axis A at angles of 45° to one another. An outer support column 8 with a weld-in pin 6 is connected to the base 9. An inner support column 7 telescopes within the outer support column 8. The inner support column 7 has multiple vertical seat height adjustment holes 15-21 and supports a pivot plate assembly system 24. Pivot joint 3 and 3A adjusts the angle of a seat 1 which provides a platform for supporting at least a portion of a person's body. The pivot joints 3 and 3A have quick release pinholes 11-13 which are arcuately spaced to set the desired angle of seat 1. There is a locking pin hole 10 (FIG. 5) for a locking pivot pin 4 to secure said seat assembly 24 (FIGS. 1, 2 and 3) to said inner support column 7 at hole 14. The locking pivot pin 4 is the pivot pin about which the pivot joints 3 and 3A rotate to orient the seat 1 at angles with respect to the horizontal via the locking pinhole 10. As is explained hereinafter, a locking pin 5 locks the seat 1 in an angular position with respect to axis 5.

Figure 1B:
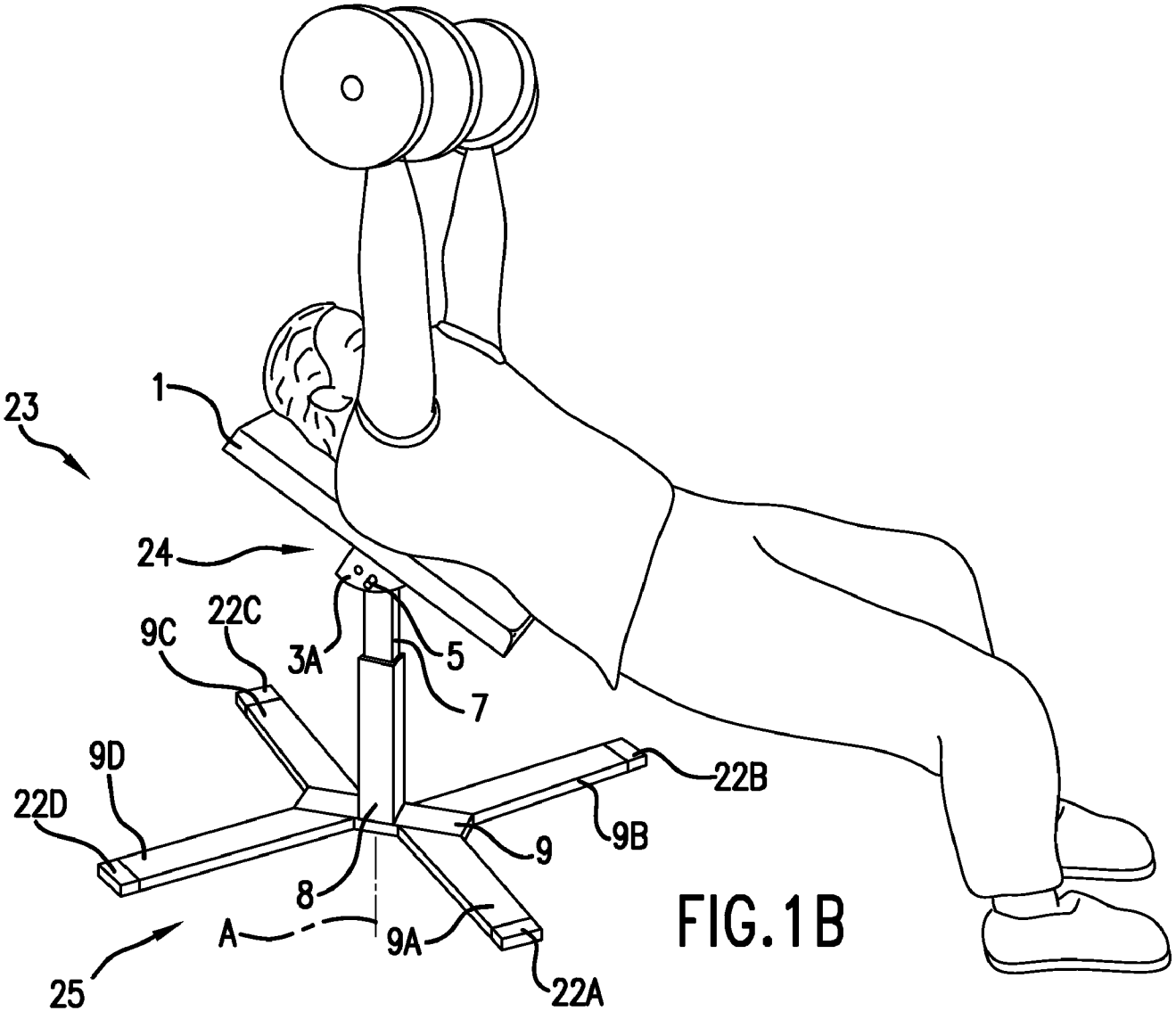
FIG. 1B is a side view showing a person supine on the training bench.
Figure 1C:
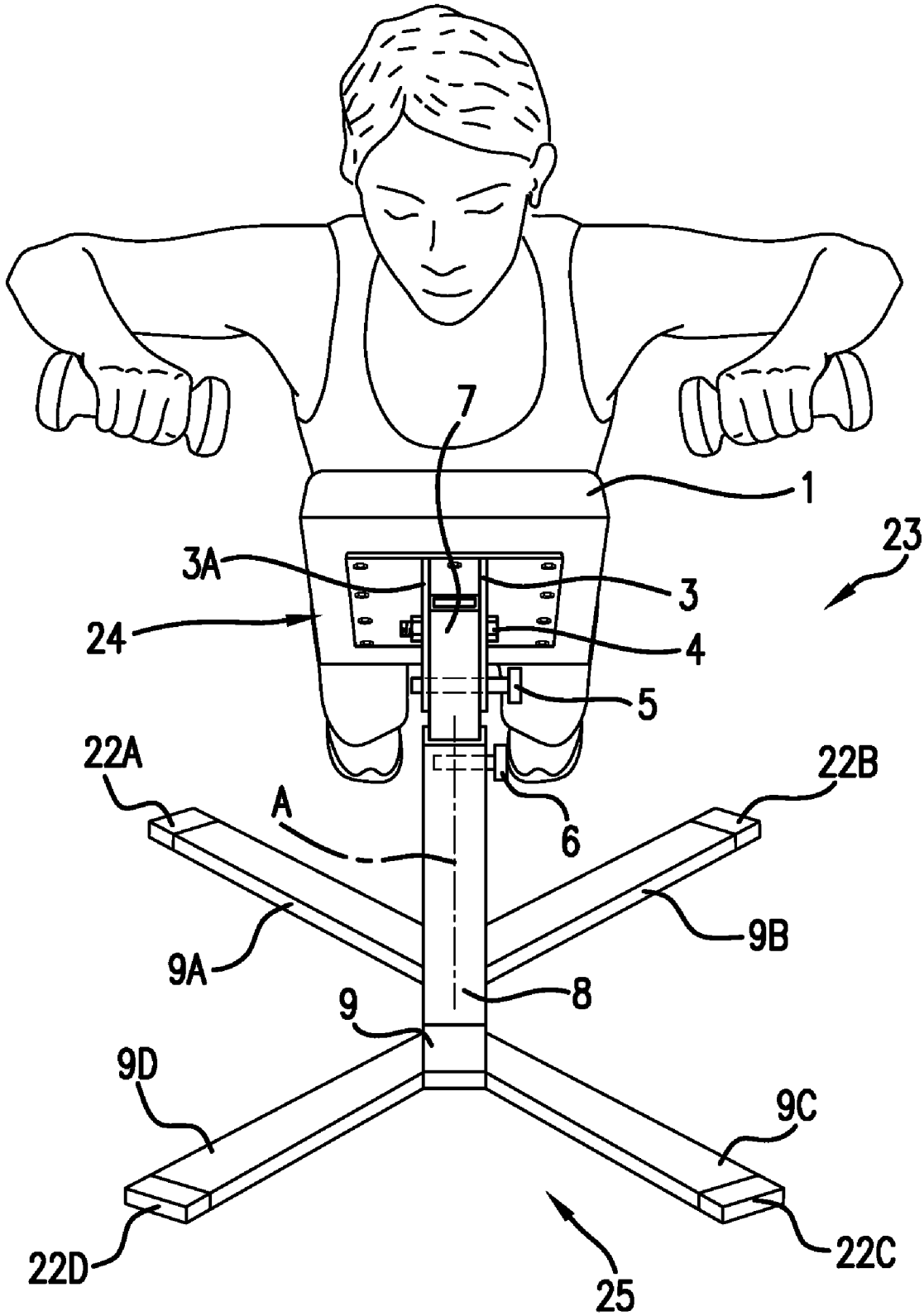
FIG. 1C is a perspective view showing the training bench of FIG. 1A as used to support the torso of a person prone on the training bench.
Figure 1D:
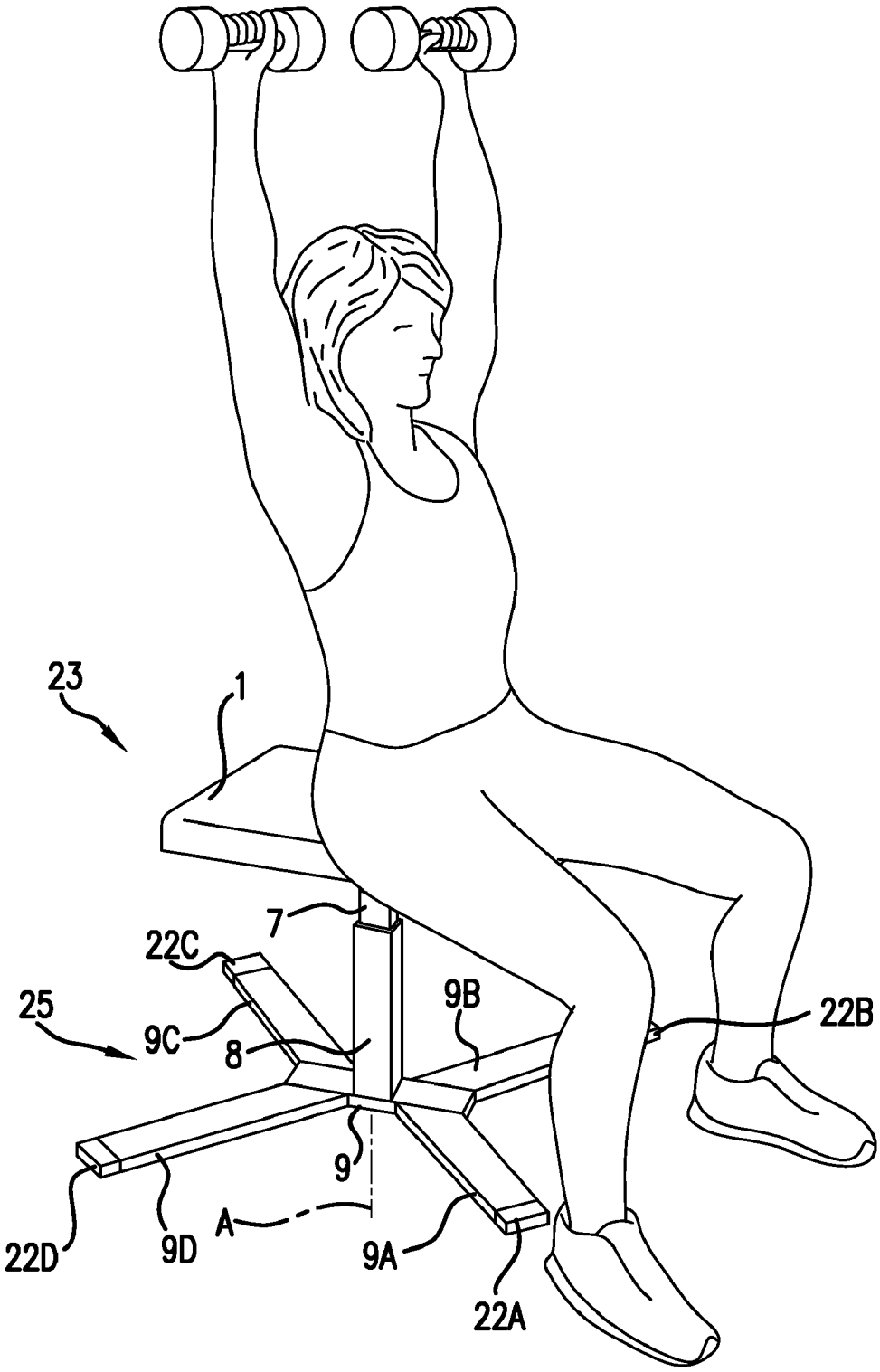
FIG. 1D is a front view showing the training bench of FIG. 1A as used by a sitting person.

Referring now more specifically to FIGS. 1B and 1C, it is apparent that since a user's whole body does not fit on the seat 1, a user must utilize stabilizing muscles of their abdominals and lower torso to stabilize their body when lying in the prone or supine position. The weights shown may be of any weight or configuration suitable for the exercise being performed. Depending on the use and the exercise, the legs may be being or held straight. Utilizing stabilizing muscles increases proprioreception and improves core strength. This type of training also teaches users' to activate their transverse abdominus, which is a very important muscle for spinal stabilization and overall core strength. The present invention is a viable alternative for users' who are not strong or stable enough to exercise on a stability ball (e.g., Perform Better or Power Systems). Exercising on a stability ball takes enormous core strength and focus. A person who is at the intermediate or beginner's stage of training or even rehabilitating an injury can use the training bench 23 as a progression towards using a stability ball once they have mastered exercises on the bench.

Base 25

In reference to FIG. 1A and FIG. 3 the base 25 has a base axis support 9 and legs 9A-9D which support the training bench 23 on a horizontal surface such as a floor. The base 25 can be comprised of any sturdy material such as metal alloy, steel, aluminum or plastic composite. The present invention uses steel for the base 25. The legs 9A-9D of the base 25 are solid and are configured to extend laterally away from the base axis support 9 at a 45° angles by a distance greater than the lateral extent of the platform provided by the seat 1 so as to give the platform stability. The current design has an X-shape. Other designs utilizing T or L shaped legs can be considered as alternatives for constructing the base 25. Another approach is to have hinges on the base legs 9A-9D that allow the legs to fold under the unit when a person is ready to store the base.

The base 25 is configured to allow a user to put a band underneath the base axis 9 to perform upper and lower body exercises. A user can easily perform various types of presses and pulls with a band. Rubber padded feet 22A-22D are attached to the ends of the base legs 9A-9D to insure lateral stability, avoid sliding of the base on the floor, and to provide protection from scratching to wood based surfaces.

The X-design enables a user who is performing upper or lower body exercises to comfortably place their feet on the floor on the inside or outside of the base 25. A user can align their feet in the proper body position to insure that proper techniques are used when exercising.

Main and Inner Support Columns 8 and 7

Figure 6:
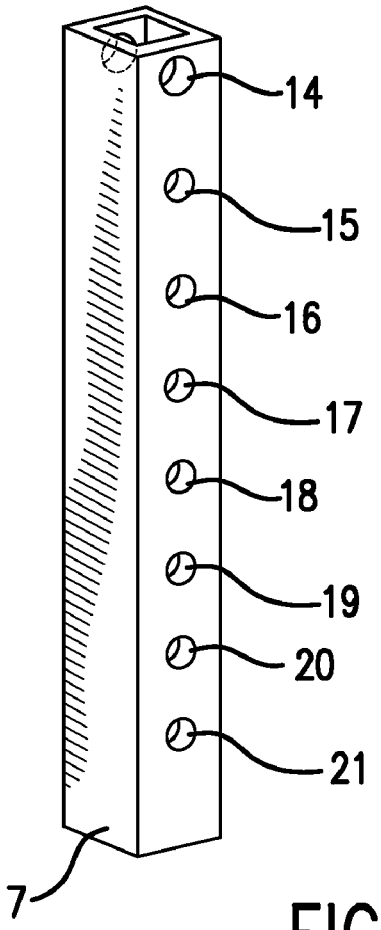
FIG. 6 is a perspective view of an inner support column with a locking pinhole, a quick release pinhole and vertical seat height adjustment holes.
Figure 7:
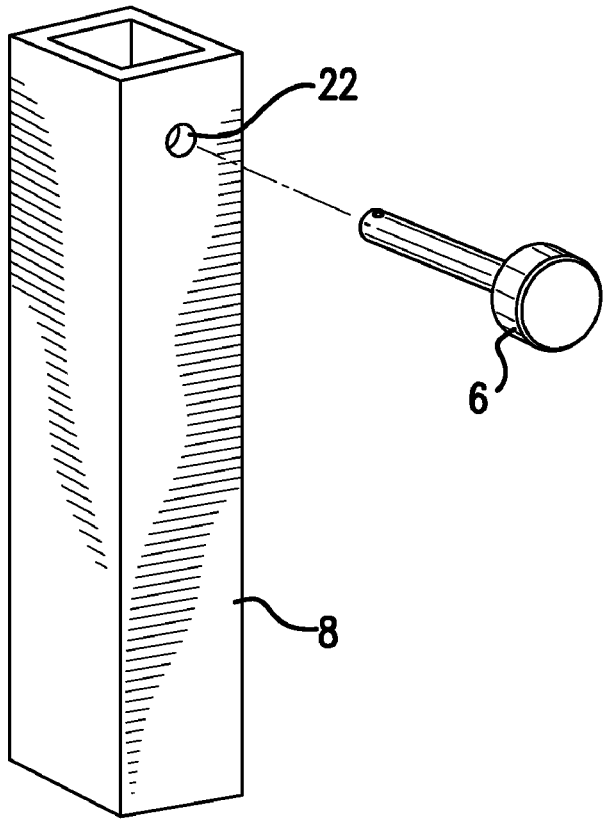
FIG. 7 shows a side perspective view of the main support column with a hole for a weld-in pin to lock-in seat height when inner support column is inserted into the main support column.

As is apparent from FIGS. 1A, 6 and 7, the main support column 8 attaches rigidly to the base axis portion 9. The main support column 8 extends vertically in the direction of a vertical axis A through the base 9 and is preferably constructed of steel. Any suitable material strong enough to support a user or heavily weighted load can be used to construct the main support column 8 such as, metal alloy, aluminum, plastic or plastic composite. The main support column 8 has a weld-in pinhole 22 for slidably receiving a weld-in pin 6. The weld-in pin 6 secures the seat height to the inner support column in FIG. 1. The pin 6 is a basic spring loaded pull pin which is slidable and that easily pulls out and then locks back. It is recommended a steel pin 6 be used if one is considering using heavy loads on the bench to exercise.

In the illustrated embodiment the main support column 8 for the present invention is welded to the base axis support 9. However, one might also consider using a hinge on the main support column 8 that would allow folding downward collapse of the support column 8 for easy storage.

In the illustrated embodiment, the inner support column 7 slides up and down (telescopes) in the main support column 8 to form a rigid telescoping tube having a polygonal configuration (square) to prevent rotation. The maximum height the inner support column 7 is adjustable to suite the user. The ability for a user to adjust the training bench 23 vertically is a unique approach in the training bench art.

In the illustrated embodiment the inner support column 7 has vertical seat height adjustment holes 16-21. These add to the ergonomics of the present invention. Regardless of a person height or size, the training bench 23 is adjustable to fit a user's height and needs. This creates safe effective exercises and comfort when exercising. Being in the right body position insures a safe full range of motion when performing exercises, which maximizes the health benefits of exercise.

In the illustrated embodiment, inner support column 7 versatility along with the pivot plate assembly system 24 is especially important for athletes, physical therapist and strength coaches. A subtle change in positioning during exercise allows different muscles to be recruited or isolated. This enables physical therapists and strength coaches to correct postural inadequacies during corrective exercises or movements.

Professional and collegiate athletes who train differently from the normal population have to maintain postural integrity during exercise. Postural integrity insures that proper body mechanics and proper muscles are being recruited during exercise. Muscular imbalances can lead to injury, which inhibits an athlete's performance.

Improper technique while exercising due to insufficient equipment decreases the effectiveness of exercises. For example, a 6'10 basketball player performing a single leg squat on a standard exercise bench will have a harder time stabilizing their body because the bench seat is too low. This can either cause an injury or poor technique. The training bench 23 addresses this issue because the inner support column 7 can be raised to the proper height for an athlete who is tall.

Pivot Assembly System 24 for seat 1

In reference to FIG. 1 and FIG. 4, the pivot plate assembly system 24 has a quick release locking pin 5, which is easily removed and a locking pivot pin 4, which secures the entire unit. The present invention has three different angles for seat 1. The quick release pinholes 11-13 are located on a pivot joint 3 and 3A. In preferred arrangement, a user has the option to secure the seat 1 in a neutral position 11, a 30° angle with pinhole 12 or a 45° angle with a pinhole 13, using the locking pin 5 to perform lower and upper body exercises.

In the illustrated embodiment, the ability to change the angles of seat 1 increases the versatility of training bench 23. Another benefit is the bench 23 can be configured to a user's personal preference. A person who is tall performing supine stability incline press can adjust said inner support column 7 height to position 6 because of the ergonomic fit. Standard benches do not have that option.

In the illustrated embodiment the pivot joint 3 and 3A each have three quick release pinholes 11-13 and 11A are shown in FIG. 4. Quick release locking pin 5 for example extends horizontally through quick release pinhole 11 and 11A, which sets the seat 1 at angle of 0°, i.e., the neutral position. Quick release pinhole 12 sets the seat 1 at an angle of 30° and quick release pinhole 13 sets the seat 1 at an angle of 45°.

An advantage of having the seat 1 at different angles is that users are able to perform many different exercises from different body positions. This is because the pivot plate assembly system 24 works independently of said inner support column 7. This allows different size user's to perform the same exercises at the proper position for their size and height and insures that the user can obtain maximum benefit out of the exercise.

For instance, when said seat 1 is in quick release pin hole 11 and position 4 at pin hole 19 (intermediate height position), a shorter person can perform a supine stability dumbbell bench press and a supine hip extension, then immediately raise the inner support column 7 to position 6 (the highest seat position) for a very tall person to perform the identical exercise. Both people will benefit equally from the exercise because they are in correct body positions in relation to the bench. The versatility of the training bench 23 allows user's to super set their exercises on one station; hence this lessens the need for additional equipment to obtain a total body workout.

In the illustrated embodiment, user's who live in apartments, town houses, condominiums or do not have space in their house for multiple pieces of equipment can still get a quality total body workout with the training bench 23. It does consume excessive space and its lightweight design enables it to be moved easily. Exercise bands with handles, dumbbells or your own bodyweight (e.g., Fig Tube and York Barbell) can be used. The ability to adjust the height with said inner support column 7 and said pivot plate assembly system 24 gives the training bench 23 the versatility needed to train a user's entire body.

In reference to FIGS. 1A and 2 the seat 1 is secured to the mounting plate 2 with screws (not shown). Seat 1 can be comprised of any breathable or non-breathable material such as leather or vinyl, which is strong enough to maintain consistency with the ergonomic design of the training bench 23. The seat 1 only pivots downward to create an inclined position. The seat 1 can pivot in both directions to add to the versatility. The surface area is large enough to support a person able to use the apparatus. The strength and durability of the seat 1 allows user's to stand, jump, step up or lay in the prone or supine position.

In the illustrated embodiment, the seat 1 can be manipulated to perform a number of exercises from neutral the position 11, such as but not limited to seated over head presses, supine dumbbell presses, body weight step-ups and prone position reverse hypers. The seat 1 height is determined by the size of the user and the type of exercise being performed. In the incline position a user can perform plyometric pushups or modified pushups on seat 1. The present design is excellent for performing exercises for the rear deltoids, rotator cuff and rhomboids. Lying prone on said seat 1 using their legs as support, users can hold dumbbells, cables or bands and have free range of motion. The base 25 configuration and pivot plate assembly system 24 have nothing inhibiting a user's movement such as; bulky knobs, locking bars or the base itself.

Figure 8:
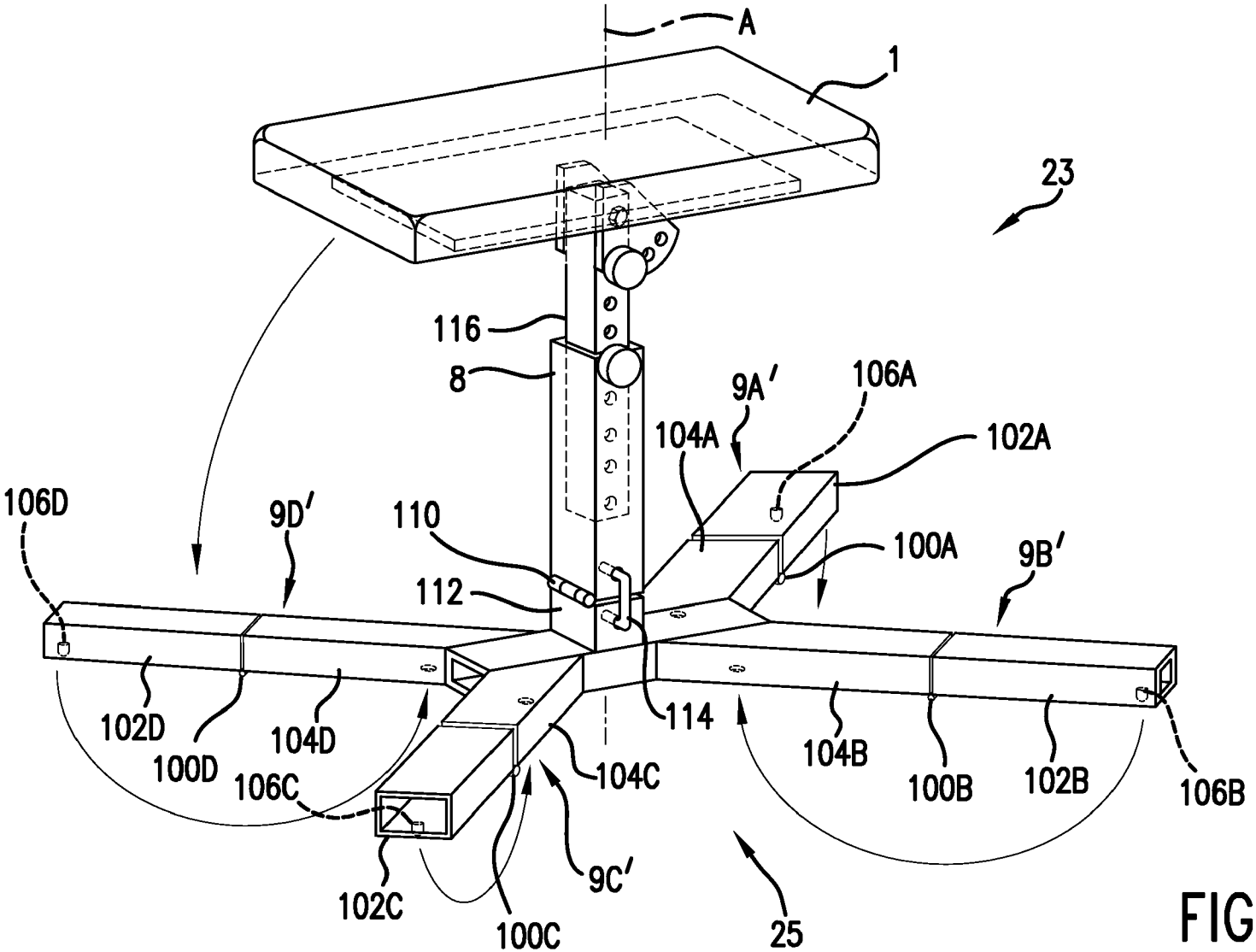
FIG. 8 is a perspective view, with portions in phantom, showing the training bench being collapsible by using hinged joints.

Referring now to FIG. 8, there is shown an embodiment of the training bench 23' with the legs 9A-9D segmented at hinges 100A-100D. The segments 100A-100D allow the base legs 9A-9D to be folded over for storage. Preferably, the hinges 100A-100D allow the base legs 9A' to fold with end portions 102A-102D folding underneath inboard portions 104A-104D. Latches 106A-106D are provided for holding the outboard portions 102A-102D back against the inboard portions 104A-104D. The latches may be recessed detents at the ends of out portions 102A-102D which fit into recesses in the inboard portions 104A-104D to releasably hold the leg portions folded one against the other.

A hinge 110 is placed in the bottom portion of support column 8 to allow the column to fold over and be coextensive with the folded legs 9A'-9D'. The seat 1 then has room to nest between the upper portions of the column 8 and a lower portion 112 of the column 8 to provide a first collapsible version of the training bench. A lock 114 is provided for locking the hinged portion 116 of the column and the upright position shown in FIG. 8 and may also lock the hinged portion of the collar and a folded position, wherein the top portion 116 of the column extends parallel to the legs 19A'-19D'. The resulting bench is collapsible into a compact package for storage.

Figure 9:
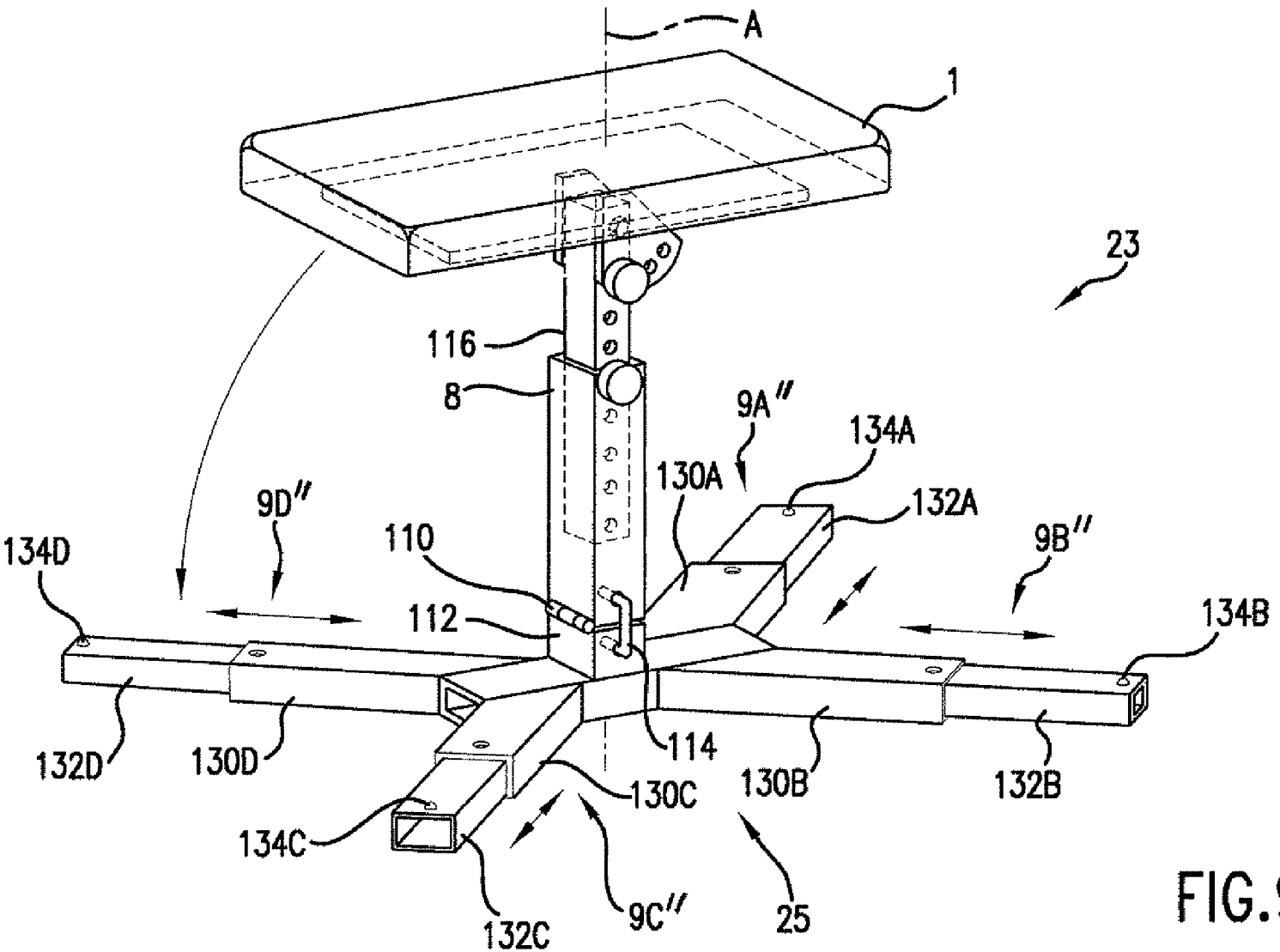
FIG. 9 is a perspective view, with portions in phantom, showing the training bench being made more compact by having telescoping base legs.

Referring now to FIG. 9, there is shown a second version of the collapsible bench 23'. The difference between the first version and the second version of FIG. 9 is that the base legs 9A"-9D" telescope instead of folding. In the embodiment of FIG. 9A"-9D" the base legs have a hollow inboard portions 130A-130D which receive therein hollow outboard portions 132A-132D which telescope into the hollow inboard portions. Each of the legs 132A-132D has a latch 134A-134D, respectively, which latches with the respective inboard leg 130A-130D to lock the legs together. This shortens the extent of the base legs 9A"-9D" so as to facilitate creation of a smaller package for the training bench for storage of the training bench.

Figure 10:
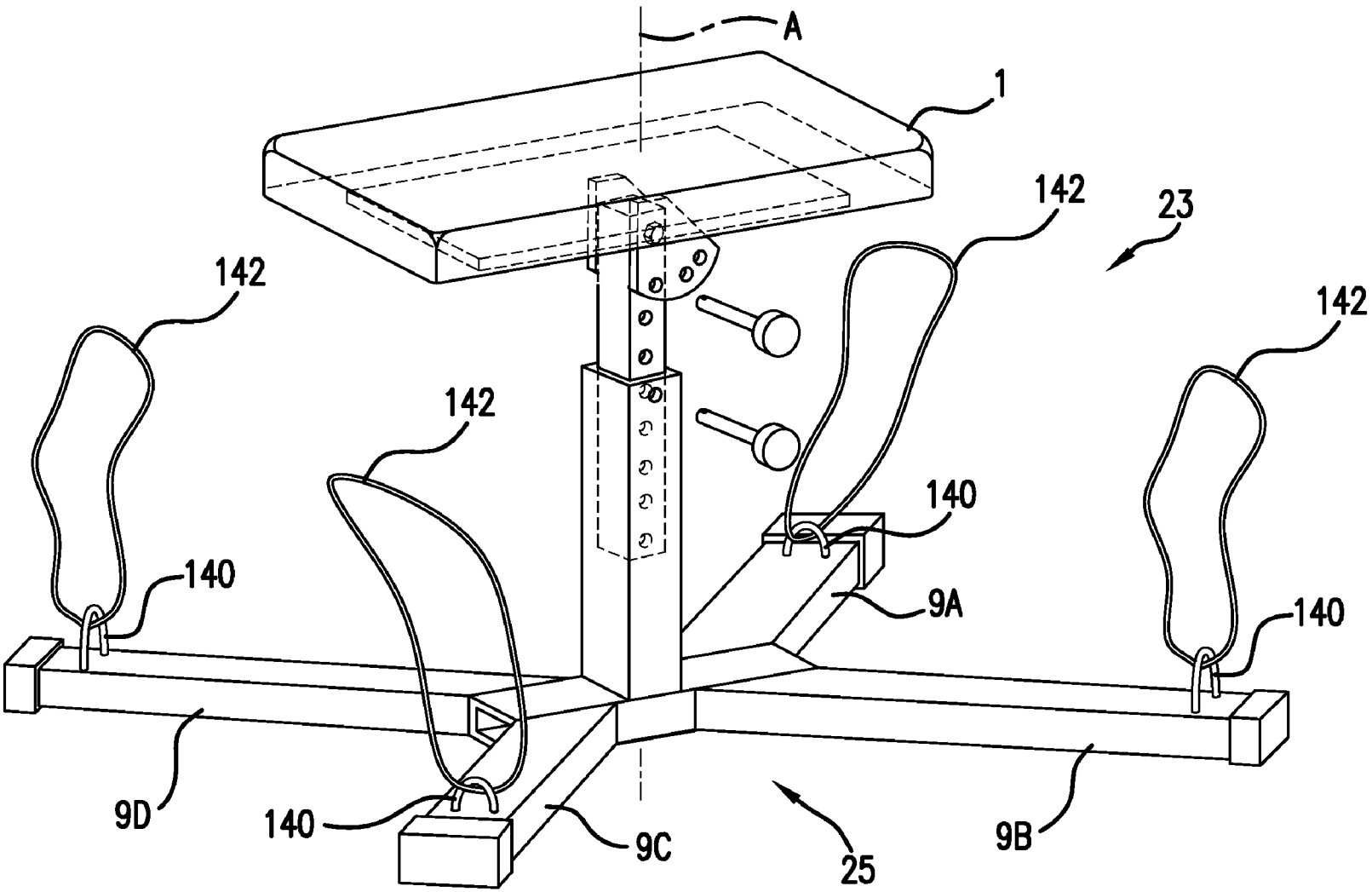
FIG. 10 is a perspective view of the training bench with bands on the base legs.

Referring now to FIG. 10, there is shown another embodiment of the invention wherein the base legs 9A-9D each have U-shaped band attachments 140 welded thereto. The band attachments 140 provide anchors for attaching bands or tubing 142, which may be made of elastic or non-elastic material and are used to facilitate exercises employing the training bench 23.

Figure 11:
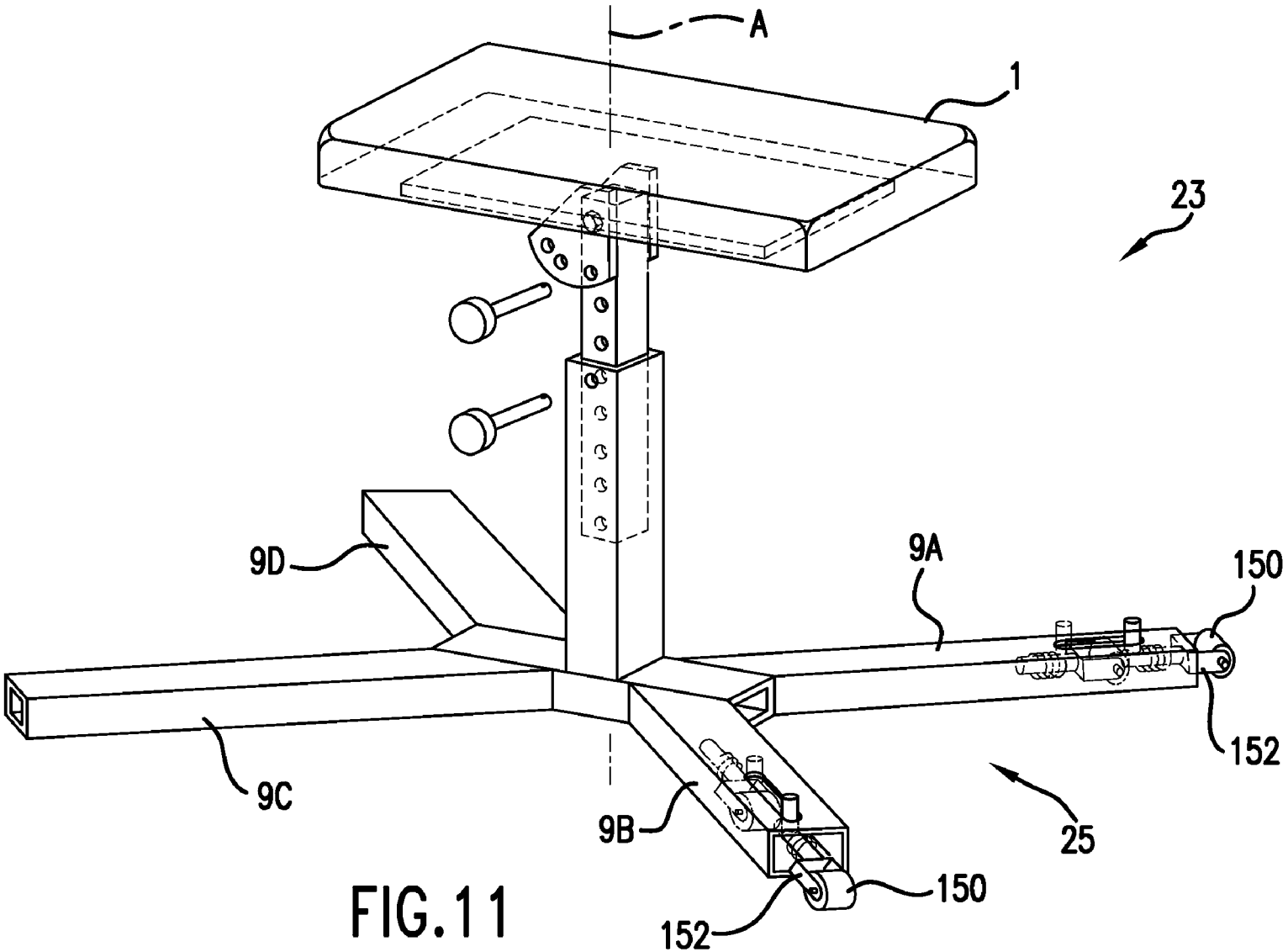
FIG. 11 is a perspective view of the training bench with wheels attached to two of the base legs.

FIG. 11 is directed to the concept of a training bench 23 with wheels 150 that project from a pair of base legs 9A and 9B so that the bench may be more easily moved around a work out area. Preferably, the wheels 150 are attached by welding a bracket 152 that holds the wheels in place. In order to move the training bench, the training bench is tipped up until the wheels contact the floor and is pushed or pulled to different location. Preferably, the wheels 150 retract into the base legs 9A or 9B via a spring release lever assembled in the main support problem. The spring release lever releases or retracts the wheels.

Figure 12:
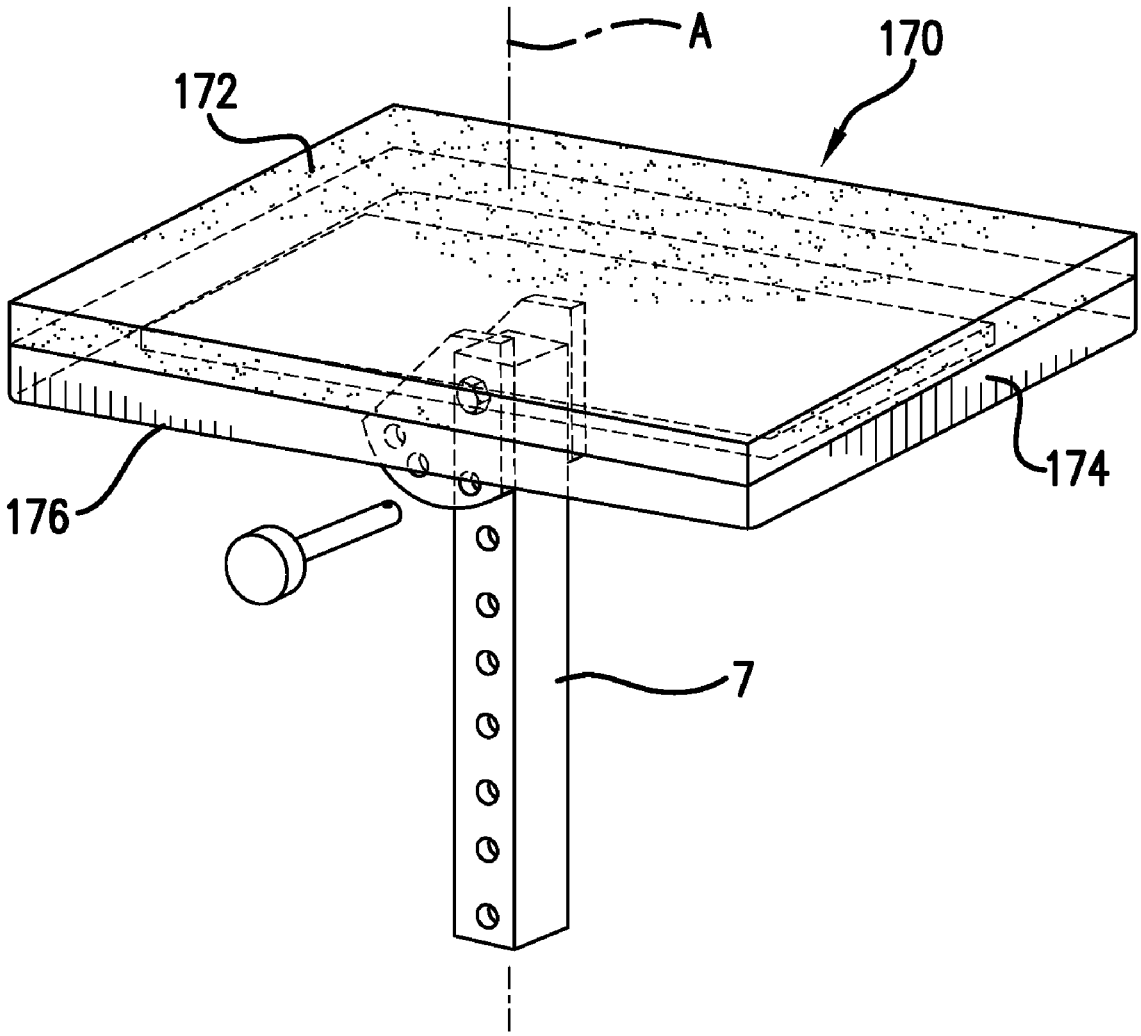
FIG. 12 is a perspective view of a seat configuration having a base portion and a rubber mat.

Referring now to FIG. 12, the version of the functional training bench of FIGS. 1-11 is initially provided with an industry standard breathable, foam seat pad for supporting an exercisers torso. Since the training bench is designed to form both upper and lower body exercises, and lower body exercises require foot placement on the foam seat pad 1, however excessive foot placement increases wear to the seat. Accordingly, it is desirable to have a more convenient arrangement for foot support when performing foot placement on the seat for lower body exercises. The seat accessory 170 shows this arrangement, which is a footrest.

The seat accessory 170 has a rubber or synthetic rubber layer 172 that is mounted on a base 174. The rubber material 172 is approximately ½ inch in thickness and the base 174 is preferably plywood having a thickness of about ¾ inch. The plywood base 174 is secured to the pivotal mounting plate 2 with wood screws. The edges 176 of the plywood base 176 are preferably covered with a plastic trim or a plastic cover so that the plywood is not exposed.

In a preferred configuration, the accessory seat 170 which is configured as a footrest is provided with an inner support column 7 assembled to the pivotable mounting plate 2 so that all a user need do to change seats when ready to perform lower body exercises to substitute the replacement seat 170 of FIG. 12 for the seat 1 of FIGS. 1-11.

Figure 13:
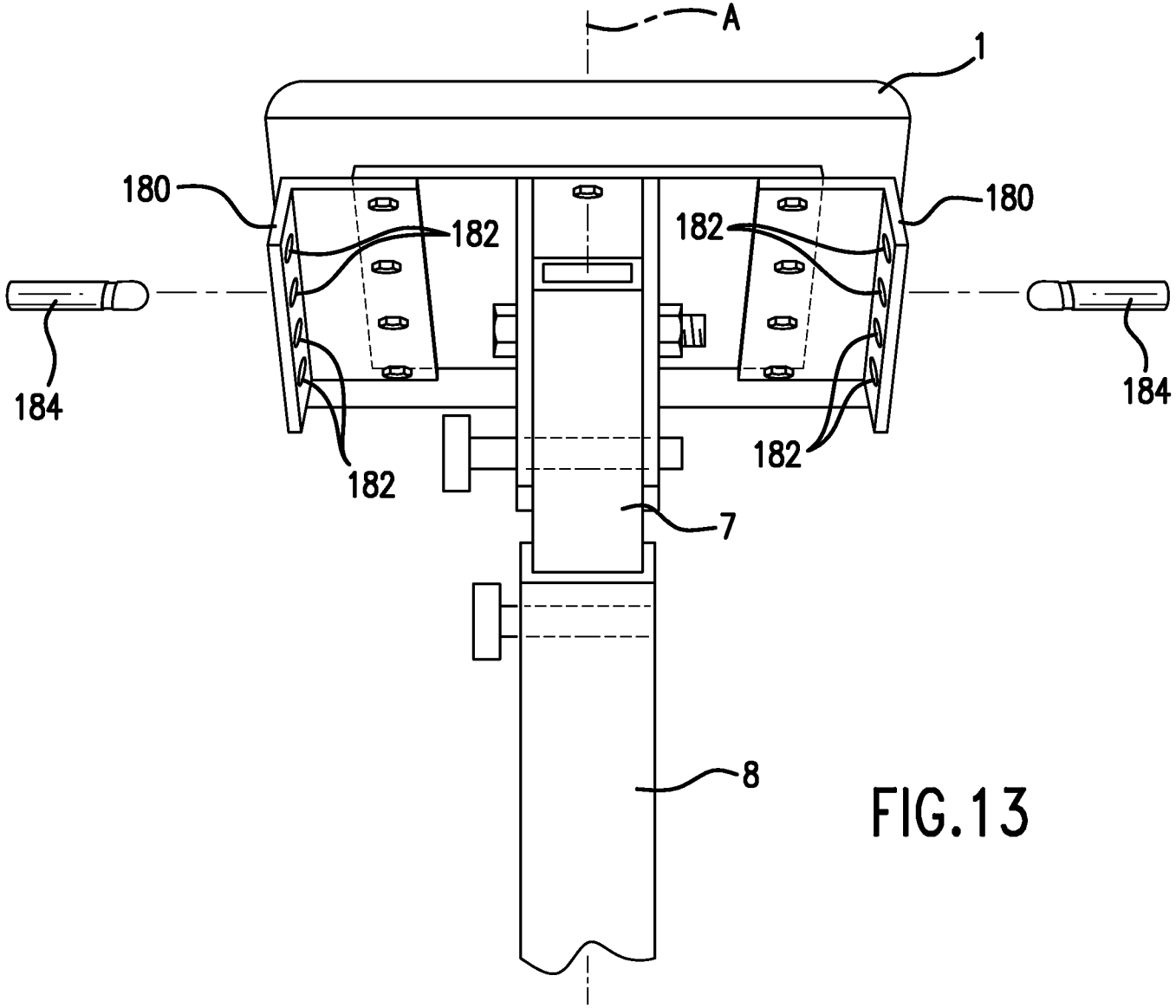
FIG. 13 is a perspective view of an arrangement for providing inter-changeable handles associated with the seat of FIG. 2.

Referring now to FIG. 13, there is shown a support plate 180 having multiple holes 182 for receiving handles 184 that are inserted therein, the handles 184 are used as hand grips to perform various exercises. The rectangular plate attaches to the bottom of the square pivot plate 2 so the person exercising can change the type seat they wish to use.

The present invention takes the traditional bench and looks at it from a functional standpoint. Adding greater functionality eliminates limitations that the traditional bench has. Said bench is comprised of a breathable foam seat cushion (like BROCK USA™ branded open celled foam) that may or may not be covered with an equally breathable and cleanable synthetic covering.

A pivoting structural square uniformly dimensional) plate with multiple angular seat adjustment holes supports the attached seat cushion. The plate attaches to the top of the inner support column to hold the assembly in position.

A spring-loaded quick release steel pin is used for angular seat adjustment. Once the desired angle of the seat is chosen, the quick release pin is placed through the hole and locks the seat into position.

A main and inner support column is constructed with the vertical seat height adjustment holes. The main support column holds the inner support column in place when the seat is adjusted to the desired height.

A quick pin is attached to the main support column to lock in the desired seat height by moving the inner shaft up or down.

A structural base support the seating assembly. The main support column is attached to the axis of the steel base.

Padded rubber feet attach to the legs of the base for lateral stability. Since the rubber feet do not adjust up or down (too much complexity for the user), one option is a three-point base for optimal stability on an uneven floor.

The following procedures and methodologies that describe but are not limited to the proper way to use this produce for optimum performance.

The neutral position in reference to said seat is when said seat angle is parallel in relation to the floor.

The following procedure is the correct way to adjust the compact functional training bench to perform a "box-squat to parallel". Adjust the inner support column by releasing the quick pin to either raise or lower the support column to a height when said user squats down and reaches the bottom part of the movement said users' femur is parallel in relation to the floor. Adjust the seat to the neutral position by removing the quick release pin. Straddle said center of seat with the left foot on one side and the right foot on the other side. Squat down slowly until your gluteus touches said seat then rise back up to the starting position.

The following procedure is the correct way to adjust the compact functional training bench to perform a "High Box Step-Up". Adjust the inner support column by releasing the quick pin to raise said seat to a position that is located at mid-thigh of said user while said user is standing in an upright position. Adjust said seat to the neutral position. Place one foot on said seat above the axis of said support column. Position the other foot on the floor slightly away from said compact functional training bench where said user is in a full upright position.

The following procedure is the correct way to adjust the compact functional training bench to perform an "Incline Stability Press". Adjust the inner support column by releasing the quick pin to position the support column at a height where said user can support their upper back against the seat while using their legs as support to stabilize their body. Adjust said seat to a 45 or 30 degree angle by removing the quick release pin and raising the seat from the neutral position to the prescribed angle. Reinsert said quick release pin horizontally once the angle is achieved.

The following procedure is the correct way to adjust the compact functional training bench to perform "Prone Positioned Y's & T's" for the Rotator Cuff. Adjust the inner support column by releasing the quick pin to position the support column to a height where said user is in a prone position on the seat with arms fully extended towards the ground.

The following procedure is the correct way to adjust the compact functional training bench to perform "Parallel Static Bench Jumps". Adjust the inner support column to height where said user sits on the seat said user legs are parallel in relation to the floor. Adjust the seat to the neutral position.

The following procedure is the correct way to adjust the compact functional training bench to perform "Band Military Press". Adjust the inner support column to height where said user sits on the seat said user legs are parallel in relation to the floor. Adjust said seat to the neutral position. Attach tubing to brackets located on the base legs of the training bench.

From the foregoing description, one skilled in the art can easily ascertain the essential characteristics of this invention, and without departing form the spirit and scope thereof, can make various changes and modifications of the invention to adapt it to various usages and conditions.

I claim:

1. A portable training bench for use on land comprising:

a seat pad for supporting a user in a prone or supine position thereupon when exercising on land;

an adjustable mounting plate for said the pad secured to a pivot assembly system;

a pivoting structural joint with multiple angularly positioned adjustment holes;

a locking arrangement connected to said pivoting structural joint;

an inner support column for multiple angular adjustments;

a removable locking system connecting said pivot assembly system to said inner support column;

an outer support column secured to a base and an inner support column with vertical pin adjustment holes being supported by said outer support column;

a weld-in pin connected horizontally to a side of said outer support column to secure vertical seat height adjustments on said inner support column, and a base support with two legs extending forward from said base axis and two legs extending toward said rear of said base.

2. The training bench as claimed in claim 1, wherein the seat pad is set at said multiple angular positions by removing the removable locking system and lowering the seat pad into a quick release pin hole position.

3. The training bench as claimed in claim 1, wherein the removable locking system secures the pivot assembly system by a pin inserted horizontally through the pivot joint hole and the inner support column hole.

4. The training bench of claim 1, wherein the pivoting structural joint deploys vertically and horizontally into a neutral position and multiple angular fixed positions and the inner support column deploys vertically with the pivoting structural joint and inner support column deploying independently of one another.

5. The training bench as claimed in claim 1, wherein the removable inner support column is supported by the main support column, the main support column being configured to hold the inner support column as the inner support column deploys vertically in a frontal plane.

6. The training bench as claimed in claim 5, wherein the main support column secures the removable inner support column into a selected vertical height position with the weld in pin attached horizontally to the main support column and extending horizontally through vertical pin holes located on the inner support column.

7. The training bench as claimed in claim 1, wherein the four legs of the base structure extend horizontally in the sagittal plane away from the base axis.

8. The training bench as claimed in claim 1, wherein the structural base frame has rubber feet attached to said bottom of said base legs for lateral stability and inertia.

9. A portable training bench used for physical exercise on land comprising:

a base for supporting the training bench on a horizontal surface, the base having a selected lateral extent;

a vertical support having a bottom portion attached to the base and upper portion extendible to selected fixed heights above the base by adjusting the vertical support;

a platform having a surface for supporting a portion of a person's body on the training bench, and an angular coupling connecting to the upper portion of the vertical support to the platform for allowing angular adjustment of the platform with respect to the vertical support and base in selected fixed angular positions with respect to vertical support to provide support for the back or front of the person's torso while the person's feet are on the horizontal surface, or for supporting the person's feet while the persons body is supported on the horizontal surface.

10. The training bench of claim 9 wherein the base has a lateral extent greater than the platform to provide stability to the platform.

11. The training bench of claim 10 wherein the vertical support is a telescoping tube coextensive with a vertical axis, the telescoping tube having a plurality of stops for fixing the height thereof and therefore fixing the height of the platform attached to the top portion of the vertical support.

12. The training bench of claim 11 wherein the stops are spaced fixed positions defined by holes in the telescoping tube which receive a pin to lock the tube at a selected height.

13. The training bench of claim 12 wherein the angular coupling is mounted on the telescoping tube by a pivot pin and wherein the angular coupling has a plurality of angularly spaced holes therein which are spaced from the pivot pin so that the holes align with at least one hole in the top portion of the telescoping tube and receive a locking pin to fix the angular orientation of the platform with respect to the tube.

14. The training bench of claim 10 wherein the base is comprised of a plurality of legs extending laterally of a vertical axis with respect to which the platform pivots.

15. The training bench of claim 14 wherein the legs fold or telescope to reduce the extent thereof for storage.

16. The training bench of claim 15 wherein the vertical support is a telescoping tube which is hinged with respect to the base so as to fold with respect to the base for storage.

17. The training bench of claim 13 wherein the platform is alternately configured as a seat for supporting a person's body or a foot rest for supporting a person's feet, and wherein each platform includes an annular coupling and a top tubular member wherein the seat or foot rest are alternately mountable.

18. The training bench of claim 14 wherein the legs include attachments for securing loops to the legs.

19. The training bench of claim 9 wherein the platform is a seat and wherein the platform includes laterally projecting handles for gripping by the person using the training bench.

* * * * *